US005493991A

United States Patent [19]

Wright et al.

[11] Patent Number: 5,493,991

[45] Date of Patent: Feb. 27, 1996

[54] APPARATUS FOR SECURING A WATERCRAFT TO A DOCK

[76] Inventors: William H. Wright, 3549 W. Lakeside Dr.; Terrall S. Wright, 4305 Bon Dell Dr., both of Birmingham, Ala. 35243

[21] Appl. No.: 378,035

[22] Filed: Jan. 24, 1995

[51] Int. Cl.[6] ..... B63B 21/00

[52] U.S. Cl. ..... 114/230

[58] Field of Search ..... 114/230, 293, 114/219, 221 R, 263; 405/219

[56] References Cited

U.S. PATENT DOCUMENTS

| | | | |
|---|---|---|---|
| Re. 25,372 | 4/1963 | Dick | 114/230 |
| 2,155,043 | 4/1939 | Gorskey | 114/230 |
| 2,912,953 | 9/1955 | Olsen | 114/230 |
| 2,979,014 | 6/1959 | Yordi | 114/230 |
| 3,067,615 | 10/1959 | Waltman | 114/230 |
| 4,066,030 | 1/1978 | Milone | 114/230 |
| 4,144,831 | 3/1979 | Heydolph | 114/230 |
| 5,014,638 | 5/1991 | Ilves et al. | 114/230 |
| 5,138,965 | 8/1992 | Culp | 114/230 |
| 5,243,926 | 9/1993 | Wright et al. | 114/230 |
| 5,301,628 | 4/1994 | Daskalides | 114/230 |

FOREIGN PATENT DOCUMENTS

| | | | |
|---|---|---|---|
| 2098560 | 11/1982 | United Kingdom | 114/230 |

*Primary Examiner*—Edwin L. Swinehart
*Attorney, Agent, or Firm*—Pettis & McDonald

[57] ABSTRACT

An apparatus for securing a watercraft in spaced apart relation to a mooring facility, including but not limited to docks. The apparatus controls horizontal movement of the watercraft, but allows free vertical movement with the rise and fall of the water supporting the watercraft. The apparatus comprises a longitudinal beam that is attached to the dock in a generally vertical orientation and a channel member that is slidably carried by the beam. A first arm and a second arm are longitudinally joined by a flexible connector and the free end of the first arm is attached to the channel member. The apparatus further comprises a guide comprising a fender and a longitudinal element that extends therefrom. The free end of the longitudinal element is attached to the free end of the second arm and a clamp is adjustably attached to the element. The clamp has structure thereon for attaching the clamp to a water craft.

11 Claims, 6 Drawing Sheets

APPARATUS FOR SECURING A WATERCRAFT TO A DOCK

BACKGROUND OF THE INVENTION

1. Field of the Invention

The present invention relates to an apparatus for attaching a watercraft to a dock permitting vertical and/or horizontal controlled movement in relation to the dock. The apparatus may be used for many sizes of watercraft, but is particularly suitable for small boats and personal watercraft.

2. Description of the Prior Art

The problems related to securing watercraft to docks are well known and yet current solutions still remain unsatisfactory. Any such device must compensate for water movement caused by tidal changes, turbulence due to bad weather or due to other watercraft, or wind striking the water. Uncontrolled movements of the watercraft create opportunities for damage to the watercraft, to the dock or to adjacent watercraft also tied to the dock or anchored in nearby waters.

Mooring devices for mooring water craft are well known in the art. One such device is disclosed by U.S. Pat. No. 2,979,014, issued to A. H. Yordi. The device comprises a column having one end buried in the bed of the body of water and the other end extending upwardly beyond the dock. The column is also attached directly to the dock. A collar with an arm attached thereto to is mounted to the column by rollers so that the collar and arm may move freely along the column. A counter weight system is attached to the collar to compensate for the weight of the collar and arm and further assist the free movement of the collar. A boat is fixedly attached to the telescoping arm, which has springs to dampen lateral movement of the attached boat.

U.S. Pat. No. 2,912,953, issued to H. E. Olsen, discloses a pole driven into the bed of a body of water and a boat having an arm extending therefrom with a ring attached to one end that is placed about the pole. The arm has a spring for dampening lateral movement.

The applicant's Pat. No. 5,243,926 discloses a pair of brackets, one attached to a dock and the other attached to a boat, with an arm extending therebetween. Each end of the arm is pivotally attached to a respective bracket to permit movement of the boat with respect to the dock. The arm includes a tension spring that controls the amount of movement permitted.

Notwithstanding the existence of such prior art, it remains clear that there is a need for a simple apparatus that is adjustably attachable to various watercraft and compensates for the tide as well as strongly controlling lateral movement caused by wind or water movement.

SUMMARY OF THE INVENTION

The present invention relates to an apparatus for safely and securely restraining a watercraft adjacent to a dock that permits some movement of the watercraft to reduce the stress on the apparatus and on the watercraft. The apparatus to be useful must be simple and easy for one person to attach the watercraft to the apparatus, and it must be adjustable so that various watercraft having different points of attachment may be attached thereto.

The current apparatus eliminates the need for bumpers between the watercraft and dock as the watercraft is maintained at a distance from the dock. The apparatus maintains a more rigid control over the movement of the watercraft than is provided by other attaching systems, reducing the risk of damage to the watercraft through collision with the dock or other watercraft. The invention comprises a longitudinal beam that is attached to a dock so that the longitudinal axis of the beam is generally vertical, a channel member that is slidably carried by the beam for movement in the generally vertical direction; and a first and a second arm having a second end and first end respectively that are longitudinally connected to one another by a flexible connector. The first end of the first arm is attached to the channel member so that the first arm slidably moves with the channel member as it moves along the beam. The second end of the second arm has an attaching means mounted thereon for attaching the arm to a watercraft.

The attaching means comprises a guide and a clamp. The guide comprises a fender and a longitudinal element. The first end of the element is attached to the fender and the second end extends longitudinally therefrom. The second end of the element is slidably attached to the second end of the second arm. A clamp is slidably attached to the element for movement therealong for adjusting the clamp's position relative to the fender. The clamp has means thereon for attachment of the clamp to a watercraft.

The channel member permits the portion of the apparatus attached to the watercraft to move vertically with the watercraft as the tide rises and falls. The flexible connector permits restricted movement in the horizontal direction over the surface of the water. The guide is adjustably attached to the arm so that it engages a portion of the watercraft and maintains the watercraft at a selected distance from the dock. The clamp is adjustably attached to the element so the clamp can reach and engage the attaching point on the boat and be clamped thereto.

The invention accordingly comprises an article of manufacturer possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several view of the drawings.

DESCRIPTION OF A PREFERRED EMBODIMENT

Figure 1:
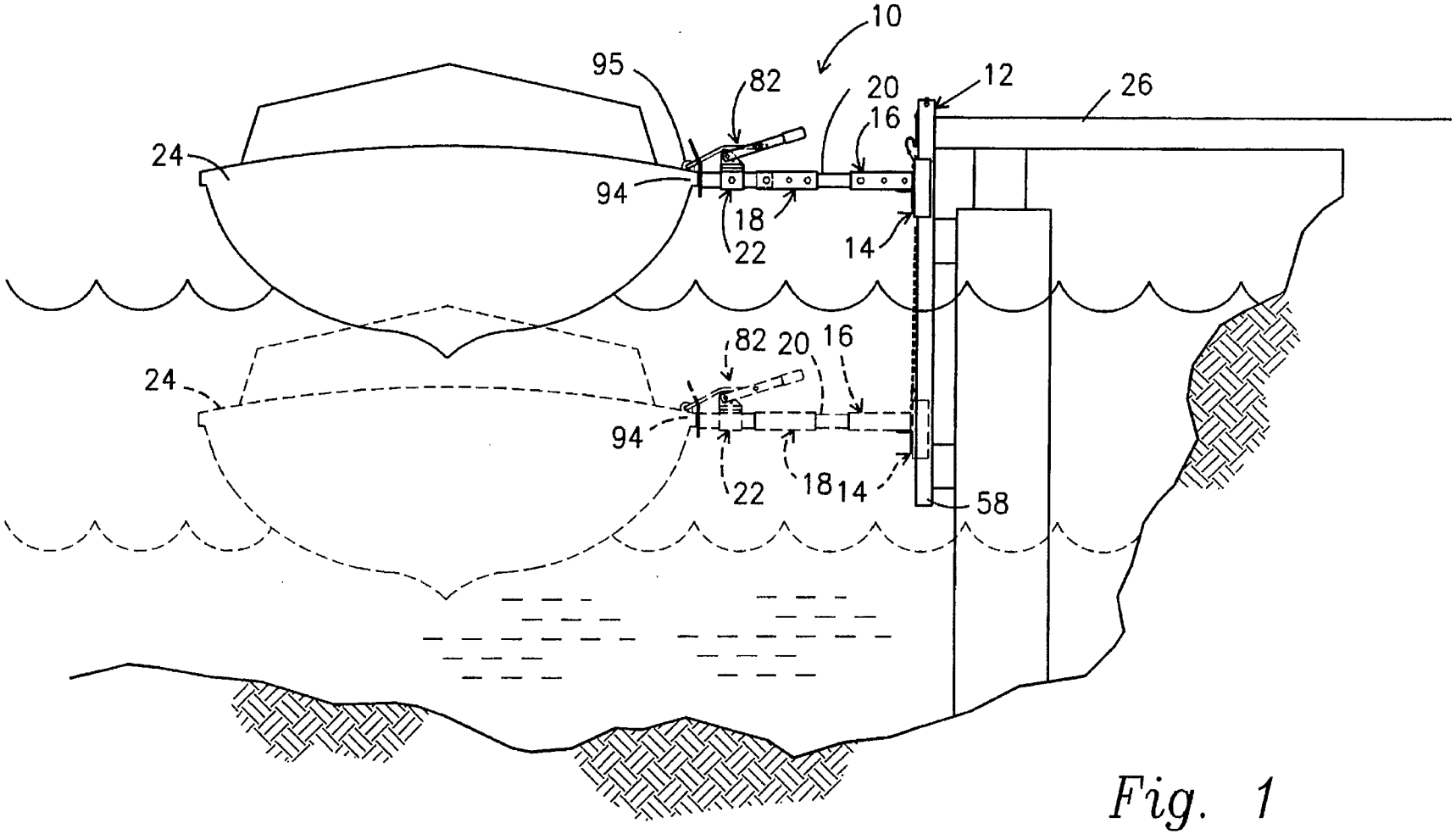
FIG. 1 is a right side elevational view of the apparatus of this invention, illustrating its attachment to a dock and to a boat.

A preferred embodiment for the apparatus for securing a watercraft to a dock is illustrated in the drawing FIGS. 1–6 and a second preferred embodiment is illustrated in drawings 7–9. The first preferred embodiment of the apparatus of the invention is generally indicated as 10 in the views of FIGS. 1 and 2, while the second embodiment of the apparatus is generally indicated as 210 in FIG. 9. Different embodiments will utilize reference numbers increased in an increment of 200 for the same parts.

Figure 2:
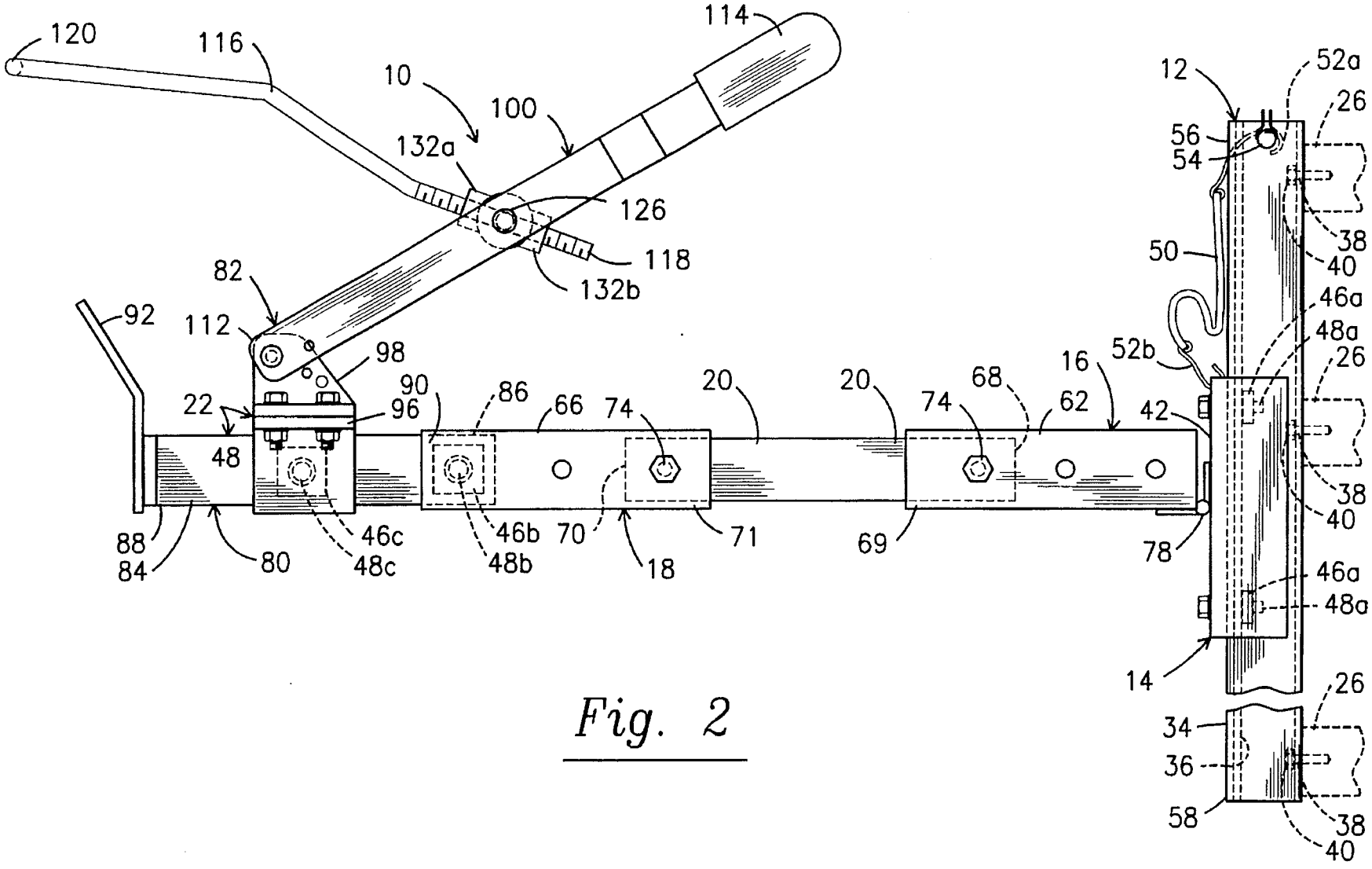
FIG. 2 is an enlarged view of the invention of FIG. 1.

In FIGS. 1 and 2 it can be seen that the first embodiment comprises a beam shown generally as 12, a channel member shown generally as 14, a first arm shown generally as 16, a second arm shown generally as 18, a flexible connector 20, and an attaching means, shown generally as 22. FIG. 1 illustrates the apparatus 10 attached to a boat 24; however, any other watercraft, such as the personal watercraft 224 shown in FIG. 9 may be attached to the apparatus 10. The apparatus 10 may be attached to a dock 26, as shown in FIG. 1, or to other suitable mooring facilities, including but not limited to floating docks and pilings. Suitable mounting means, well known in the art, must be used to attach the apparatus 10 to the mooring facility.

Figure 3:
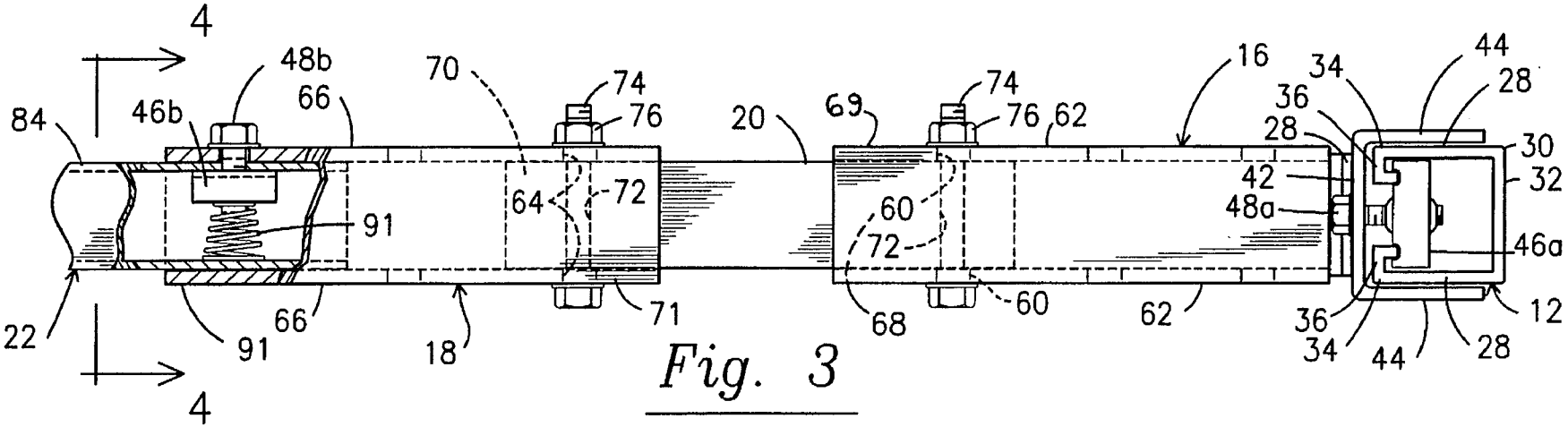
FIG. 3 is a top plan view of a portion of the apparatus of FIG. 2.
Figure 4:
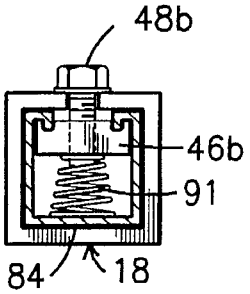
FIG. 4 is a sectional elevational view taken along line 4—4 of FIG. 3.

As can be seen in FIG. 2 and 3, the beam 12 is comprised of a pair of adjacent generally parallel legs 28 that are joined to one another at one end 30 by a beam web 32 while the other ends 34 remain free. Each of the free ends 34 of the legs 28 have an end section 36 that is bent toward the other leg 28 and then bent toward the beam web 32 to form a U-shaped end section 36. As shown in FIG. 1 and 2, the beam 12 has a plurality of holes 38 therethrough to receive lag bolts 40, or other means of attachment, therethrough for secure attachment of the beam 12 to the dock 26.

The channel member 14 is comprised of a channel web 42 and a pair of generally parallel flanges 44 that are attached to and extend from the channel web 42. The channel member 14 is sized and configured to receive the beam 12 between the flanges 44 so that the end sections 36 of the legs 28 lie adjacent to the channel web 42. The channel member 14 further comprises a plate **46*a*, best seen in FIG. 3, that is attached to the channel web 42 but spaced apart therefrom. The plate 46*a* may be attached by bolt 48*a* which is welded to the plate 46*a*, or attached by other well known means, to fix the plate 46*a* in a spaced apart position from the channel web 42. The plate 46*a* is sufficiently spaced apart from the channel web 42 to permit the end sections 36 of the beam 12 to be slidably received between the plate 46*a* and the channel web 42. A strap 50 is attached at one end by a hook 52*a* to a pin 54 that is passed through holes (not shown) through the upper end 56 of the beam 12 and the other end of the strap is attached by a hook 52*b* through a hole (not shown) in the channel member 14. The strap 50 is sized to prevent the channel member 14 from becoming detached from the lower end 58 of the beam 12 when no watercraft are attached to the apparatus 10** or when there is an exceptionally low tide.

The first arm 16 in a preferred embodiment is a hollow rectangular tube having a hole 60 through opposing sides 62. Second arm 18 is configured similarly to first arm 16 having a hole 64 through opposing sides 66.

The flexible connector 20 is a rectangularly shaped solid block of a flexible elastomeric compound. The first arm 16 is sized so that first end 68 of connector is longitudinally received therein and the second arm 18 is sized so that the second end 70 of the connector 20 is longitudinally received therein. A hole 72 is bored through the flexible connector 20 proximal to each end 68 and 70 so that the hole 72 can be aligned with the hole 60 in the first arm 16 and the hole 72 can be aligned with the hole 64 in the second arm 18. Bolts 74 are passed through holes 60 in the first arm and the holes 72 in the flexible connector 20 and secured with a nut 76 attaching the flexible connector 20 to the first arm 16. Similarly, a bolt 74 with nut 76 is used to attach the second end 70 of flexible connector 20 to the second arm 18.

The flexible connector 20 may also be comprised of a flexible synthetic resin material. The choice of material, the flexibility of that material and the spacing between the arms 16 and 18 will determine the amount of lateral movement of the boat 24 permitted by the apparatus 10. In a preferred embodiment, the preferred amount of flexibility in the connector 20 is obtained by constructing the connector 20 from a solid block of PTMEG ether urethane elastomeric compound having a 90 Shore A hardness and the block having a square cross section, each side of the square being one and five eights inches long. The space between the second end 69 of the first arm 16 and the first end 71 of the second arm 18 is approximately one and one eighth inches. The flexibility of the connector 20 reduces the stress and wear on the apparatus 10 caused by the horizontal pressures applied to the apparatus 10 by the movement of the boat 24 caused by wind and/or water movement. The flexible material of the connector 20 also permits longitudinal extension and compression of the connector 20 itself allowing limited movement of the boat 24 normal to the dock 26.

The first arm 16 is pivotally attached to channel member 14 in a preferred embodiment by a hinge 78. By being pivotally mounted in a vertical plane it permits the arm 16 and all attached parts to pivot downwardly adjacent to the beam 12 so that the apparatus 10 can be stored out of the way when it is not attached to a boat 24.

Figure 5:
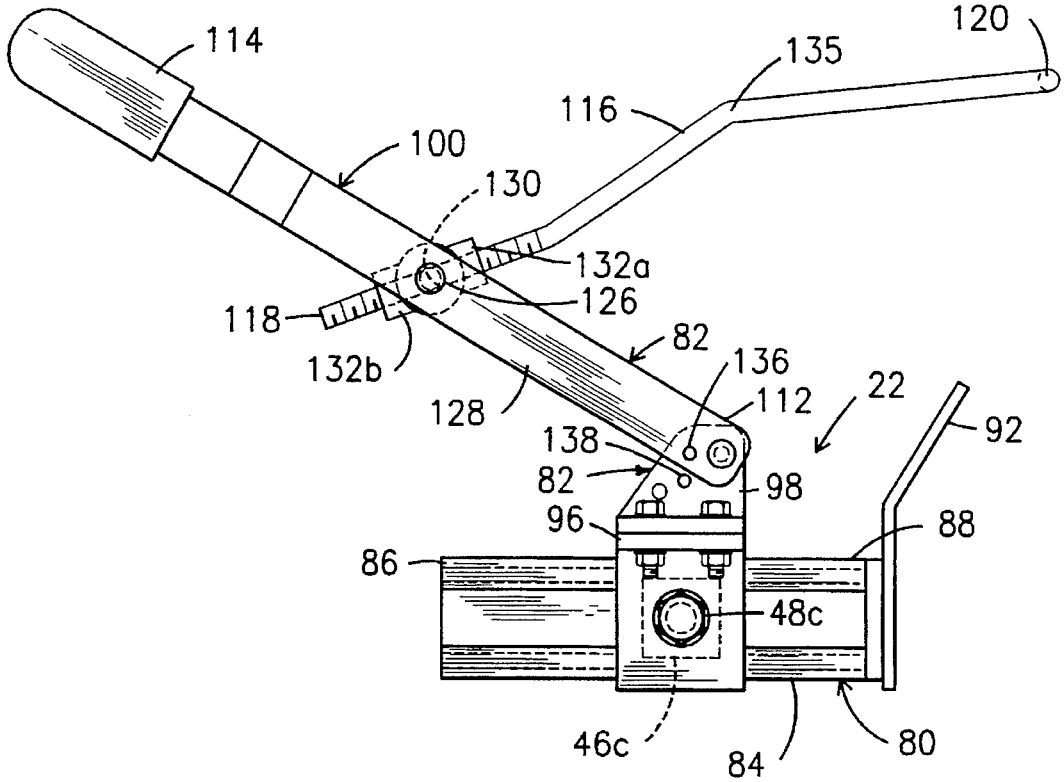
FIG. 5 is a left side elevational detail of the attaching means of the invention of FIG.2, illustrating the open position.
Figure 6:
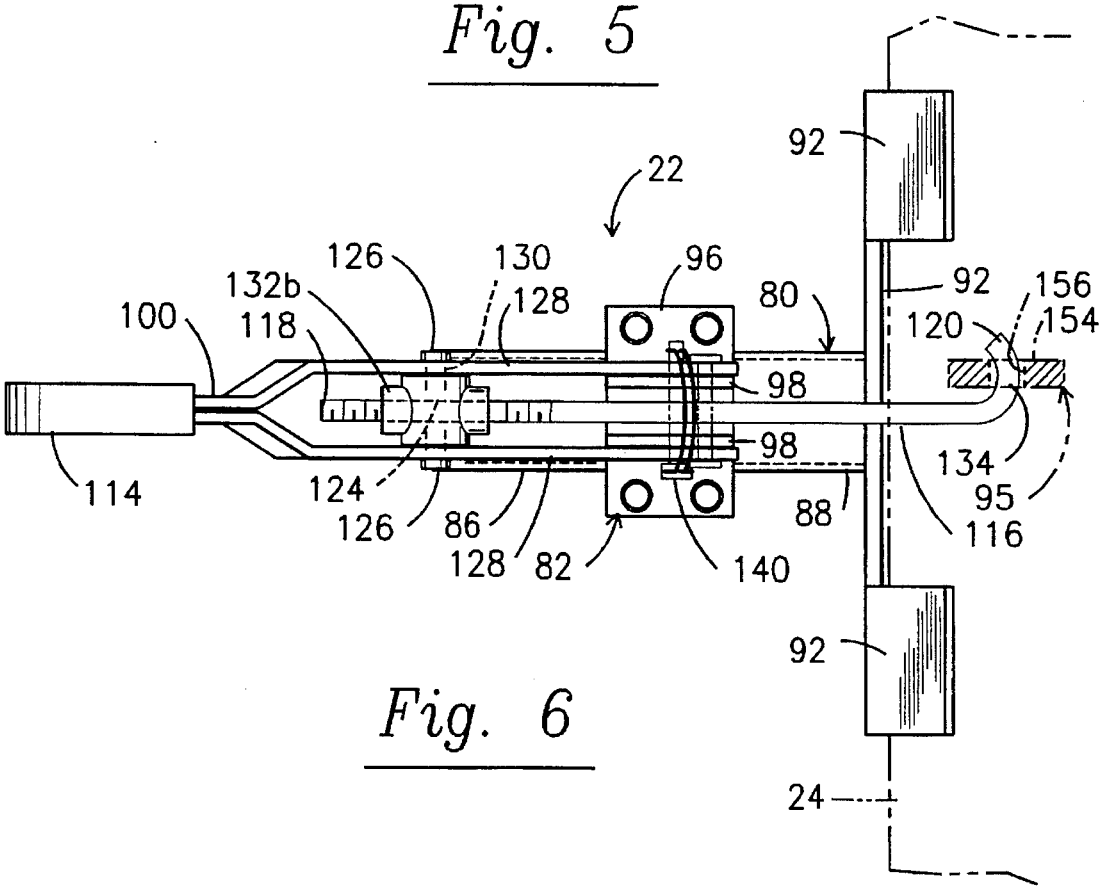
FIG. 6 is a top plan view of the detail of FIG. 5 illustrating the attaching means in the closed position and attached to a boat.

A preferred embodiment of the attaching means 22, is shown in FIGS. 2, 5 and 6, and comprises a guide, shown generally as 80, and a clamp, shown generally as 82. The guide 80 is comprised of a longitudinal element 84 having a first end 86 and a second end 88. The element 84, in the preferred embodiment, is formed similarly to the beam 12, as described above, which can be seen clearly in FIG. 4. The element 84 is sized to be received by the second end 90 of the second arm 18. In addition, in a preferred embodiment, the element 84 is adjustably attached by a similar type bolt and plate fastener as used to slidably attach the channel member 14 to the beam 12. In this case, however, the plate **46*b* may be threadably tightened by the bolt 48*b* against a portion of the element 84 firmly attaching the element 84 to the second end 90 of the second arm 18. A spring 91 extends between plate 46*b* and the element 84 to hold the plate 46*b* in position when the bolt 48*b* is loosened to permit the element 84 to slide within the second end 90 of the second arm 18**.

Attached to the second end 88 of element 84 are a plurality of plates attached to one another to form a curved fender 92. In other embodiments, the fender 92 may be constructed of a single plate and curved in various shapes to conform with the portion of the boat 24 (usually the boat's gunwale 94) that is adjacent the attachment point 95 where the clamp 82 is attached to the boat 24, as shown in FIG. 1.

The clamp 82 is comprised of a base 96 that is formed as rectangular tube that is sized and configured to be slidably received on element 84. The base 96 of the clamp 82 is adjustably attached to the element 84 using the same means as used to attach the element 84 to the second end 90 of the second arm 18. The bolt 48*c* is threadably attached to the plate 46*c* and tightened so that the plate 46*c* engages a portion of the element 84 firmly attaching the clamp 82 to the element 84. A pair of extensions 98 extend outwardly from the base 96. A lever 100 has a first end 112 that is pinned to the extensions 98 for rotation between an open position and a closed position. The lever 100 also has a second end 114.

The clamp 82 further comprises a rod 116 which has a first end 118 and a second end 120. The first end 118 of rod 116 is pivotally attached to the lever 100 at a point spaced apart from the first end 112 of the lever 100. In a preferred embodiment, as shown in FIG. 6, the means for pivotally attaching the first end 118 of the rod 116 to the lever 100 comprises a block 122 having a bore 124 therethrough. Attached to opposing sides of the block 122 are pins 126 that project outwardly from the block 122. At the point of attachment of the block 122 to the lever 100, the lever 100 comprises two segments 128 that are spaced apart from one another, each segment 128 having a hole 130 therethrough to receive the pins 126. The first end 118 of the rod 116 has threads thereon and a nut 132*a* is threaded thereon. The first end 118 of the rod 116 is inserted through the bore 124 in the block 122 and a second nut 132*b* is threaded on the first end 118. This construction permits the rod 116 to be adjustably extended from the clamp 82. The second end 120 of the rod 118 is bent back upon itself to form a hook 134. The rod 116 has a bend 135 formed therein so that in the closed position the handle can be rotated to a generally horizontal position.

Each segment 128 of the lever 100 has an aperture 136 therethrough and each extension 98 has an aperture 138 therethrough so that when the lever 100 is in the closed position the segment apertures 136 are aligned with the extension apertures 138 so that a locking pin 140 may be received by each of the apertures 136 and 138 locking the lever in the closed position, as seen in FIG. 6.

Figure 8:
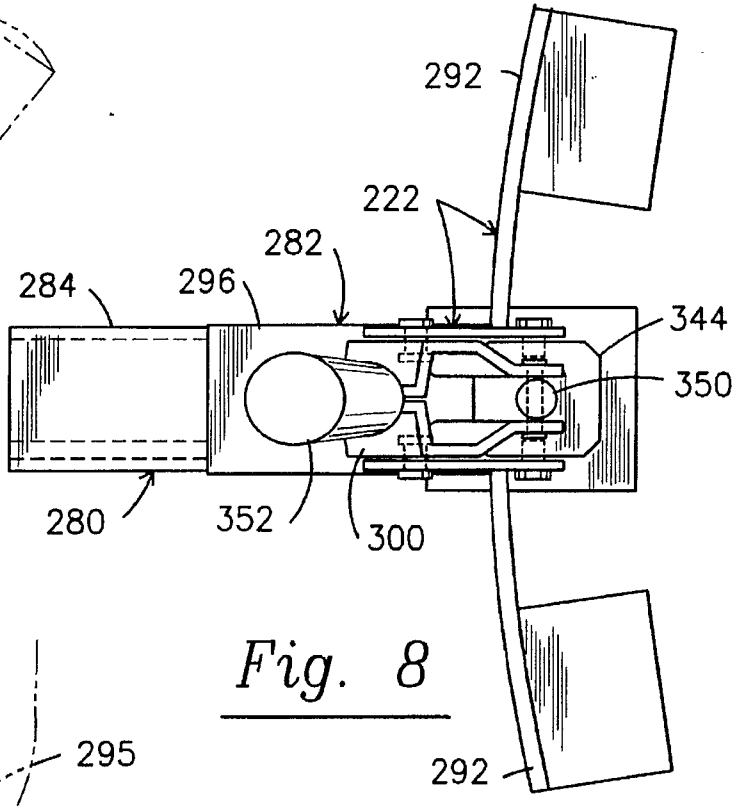
FIG. 8 is a top plan view of the detail of FIG. 7.
Figure 7:
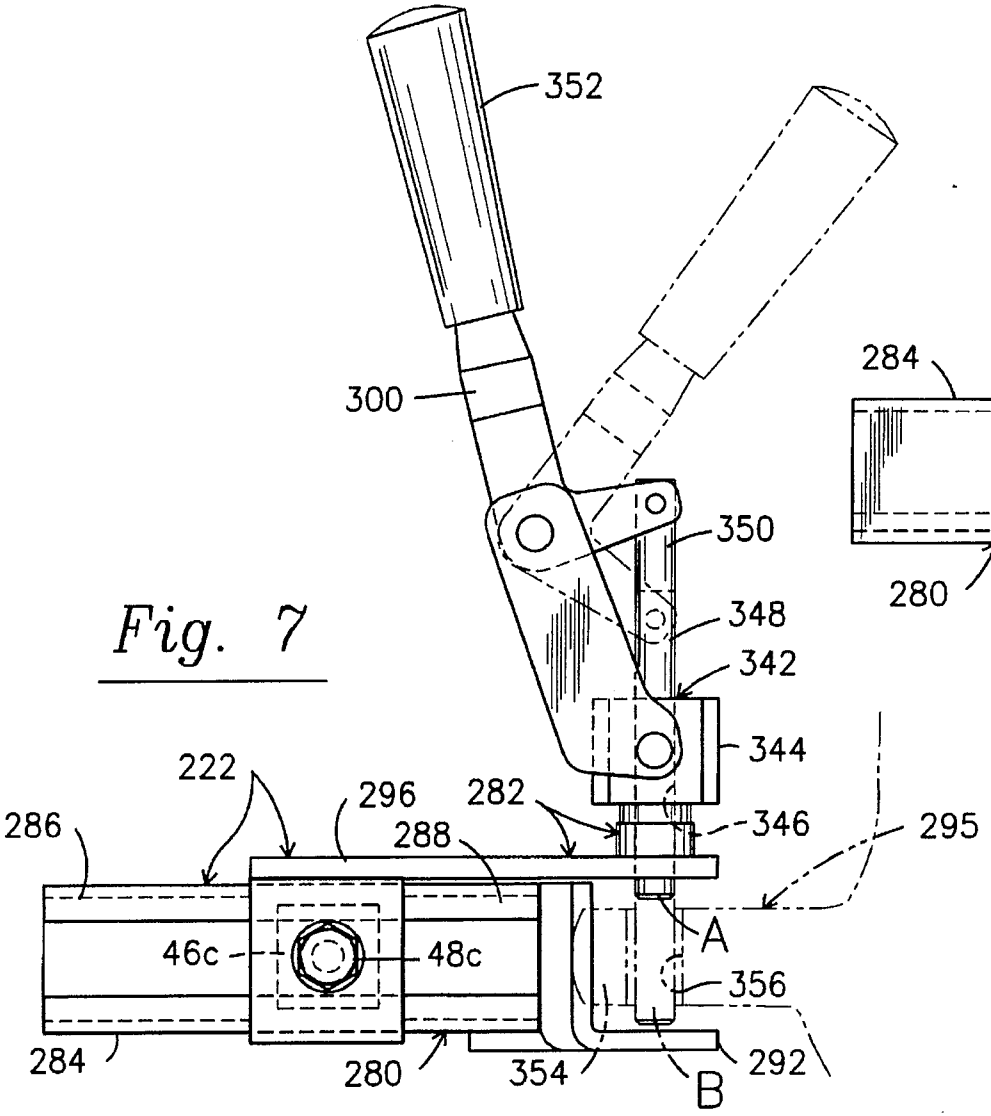
FIG. 7 is left side elevational detail view of a second embodiment of the attaching means of the invention, illustrating attachment to a personal watercraft.
Figure 9:
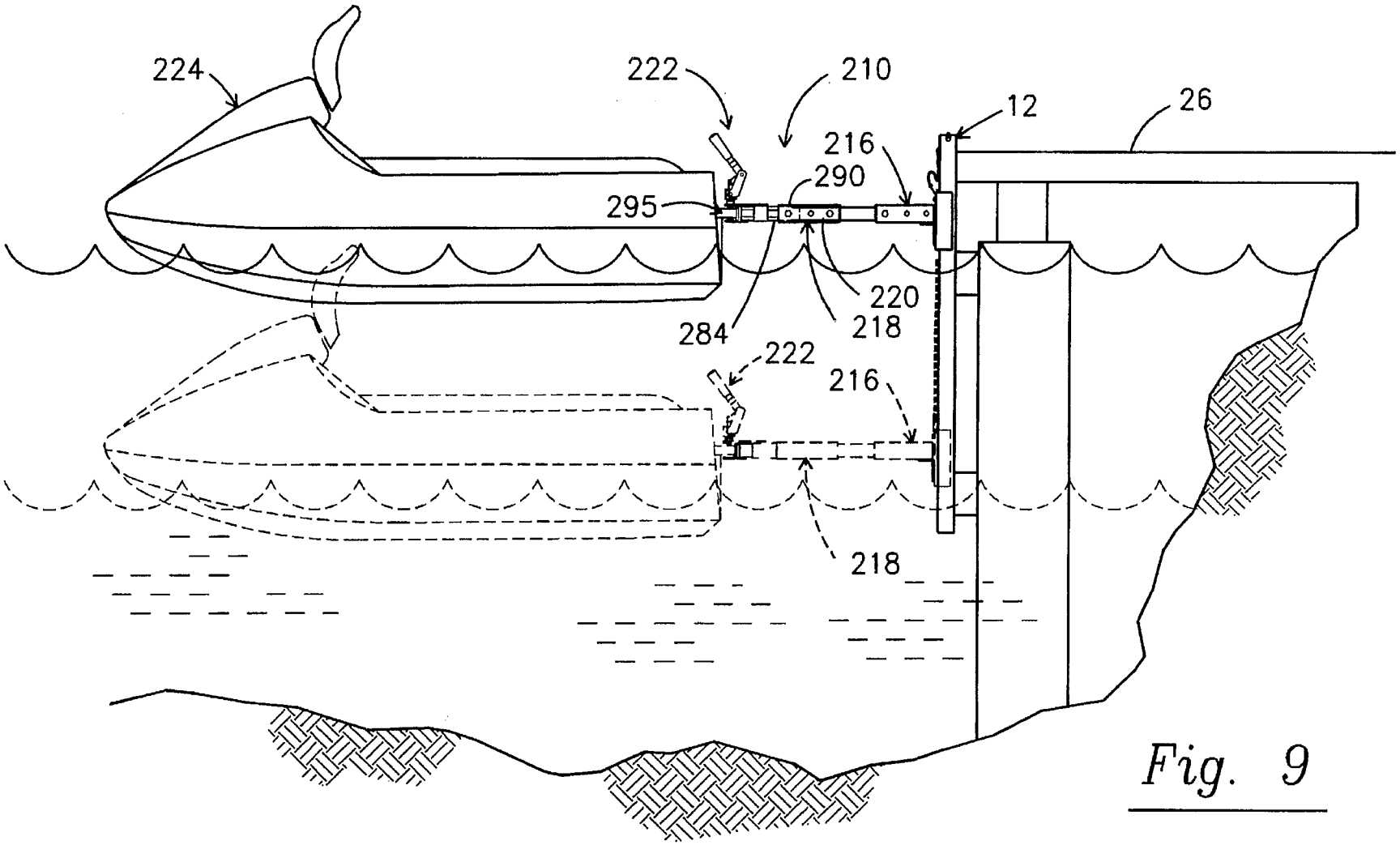
FIG. 9 is a right side elevational of the apparatus of the invention illustrating the second embodiment of the attaching means attached to a personal watercraft.

A second embodiment of the attaching means 22 is illustrated in FIGS. 7–9 where the attaching means is indicated as 222. The attaching means 222 comprises many of the structural elements of attaching means 22 and those elements will be indicated by reference characters that have been increased by an increment of 200.

The attaching means 222 comprises a guide 280 and a clamp 282. The guide is further comprised of a longitudinal element 284 and a fender 292. The first end 286 of the element 284 is received by the second end 290 of the second arm 218 as shown in FIG. 9. The fender 292 is formed similarly to fender 92 in that it is shaped to engage a portion of the watercraft proximal to the attachment point 295 on the watercraft 224. The element 284 is adjustably attached to the second end 290 of the second arm 218 by the same attaching means used to attach the element 84 to the second end 90 of the second arm 18.

The clamp 282 is comprised of a base 296 that is adjustably attached to the element 284, and a plunger mechanism 342 that extends from the base 296. The plunger mechanism 342 comprises a lever 300 and a cylinder 344 having a bore 346 therethrough. A piston 348 extends through the bore 346 with one end 350 being attached to a handle 352 for movement of at least a portion of the piston 348 within the bore 346, moving the piston 348 between an open position A and a closed position B. The piston 348 in the closed position B extends from the cylinder 344 and engages a hole 356 in the watercraft 224 attaching the watercraft 224 to the apparatus 210.

In other embodiments, the attaching means may comprise other constructions, including, but not limited to, the U-shaped saddle 12 and angle 11 disclosed in U.S. Pat. No. 5,243,926 issued to Wright, et. al., the current applicants. The second end 91 of second arm 18 may also be bolted directly to the watercraft.

In the preferred embodiment, with the exception of the flexible connector 20 and the strap 50, all parts of the apparatus 10 and 210 are made from steel for strength and durability. Other materials suitable for the purpose may be used in place of steel for some or all of the steel parts.

Having thus set forth a preferred construction for the apparatus for securing watercraft to a dock, it is to be remembered that this is but a preferred embodiment. Attention is now invited to a description of the use of the apparatus 10 and 210 for securing watercraft to a dock. In the embodiment shown in FIG. 1, the beam 12 is attached to a dock 26 by lag bolts 40 so that the beam extends generally longitudinally in a vertical orientation. Strap 50 is engaged to prevent the channel member 14 from disengaging from the lower end 58 of the beam 12. When a watercraft, in particular a boat 24 as shown in FIG. 1, is brought alongside the dock 26, the attaching means 22 is swung upwardly about the hinge 78 so that the fender 92 engages the boat 24 adjacent the attaching tab 154 as shown in FIG. 6. The locking tab 154 has a hole 156 therethrough to receive the hook 134 of the rod 116 therein. When the lever 100 is in the closed position, rod 116 pulls the boat 24 snugly against the fender 92. The locking pin 140 is then inserted through the segment apertures 136 and the extension apertures 138 locking the lever 100 in the closed position. Since the locking tab 154 on different vessels may be in different locations, i.e., different distances from the portion of the boat engaged by the fender 92, adjustment may be required to ensure a tight attachment. The rod 116 may be extended or shortened by loosening the nuts 132*a* and 132*b* and extending or contracting the rod 116 through the block 122. In addition, the base 96 of the clamp 82 may be moved along the element 84 and re-tightened to obtain the proper adjustment of the relationship between the hook 134, the locking tab 154 and the portion of the boat 24 that is engaged by the fender 92.

The distance the boat 24 is kept from the pier may be adjusted by extending element 84 from the second arm 18 or withdrawing element 84 into the arm 18. Once these adjustments are made, the boat 24 may be attached and disengaged simply by removing the locking pin 140 and moving the lever 100 to the open position so that the hook 134 on the rod 116 can be disengaged from the locking tab 154. Apparatus 10 will then be ready to receive the same boat 24 again without any further adjustment.

When using the second embodiment of the clamp 282, it is simply substituted for the clamp 82 by removal of the clamp 82 from the second end 90 of the second arm 18. The method of adjustment of the apparatus 10 when using clamp 282 is very similar to the adjustments made when using clamp 82, except that the locking tab 354 or gunwale 294 extends horizontally so that the piston 348 moves vertically into the locking tab hole 356 when moved to the closed position B As seen in FIG. 1, as the water level drops the boat 24 moves downwardly to the new position shown in phantom. The channel member 14 slides freely on the beam 12 so that arms 16 and 18 of the apparatus 10 remain generally horizontal. As waves or the wind push against the boat the apparatus 10 holds the boat 24 firmly resisting movement in horizontal directions; however, when the wave and wind pressures become strong the flexible connector 20 bends permitting the boat 24 to move relatively small distances in any horizontal direction to reduce the stress on the apparatus 10. The apparatus 10, however maintains control over the movements of the boat 24 to prevent the boat 24 from striking the dock 26 or other boats moored nearby (not shown). When the wind and water pressures subside, the solid flexible connector 20 returns the boat 24 to its original position in which the arms 16 and 18 and the connector are generally longitudinally straight and usually normal to the dock 26.

It will thus be seen that the object set forth above among those made apparent from the proceeding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. Apparatus for securing a watercraft to a dock, said apparatus comprising:

a beam having means thereon for mounting said beam to a dock;

a channel member slidably carried by said beam for movement there along;

a first arm and a second arm, each having first and second ends, said first end of said first arm being attached to said channel member;

a flexible connector having a first end attached to said second end of said first arm and a second end attached to said first end of said second arm; and an attaching means attached to said second end of said second arm, said attaching means comprising; a guide comprising a fender and a longitudinal element having a first end and a second end, said first end of said element being attached to said fender, and said second end of said element being adjustably attached to said second end of said second arm; and a clamp attached to said element for attaching said apparatus to a watercraft.

2. An apparatus as in claim 1 wherein said flexible connector is comprised of a block of solid flexible synthetic resin material.

3. Apparatus as in claim 1 wherein said flexible connector is comprised of a block of solid flexible elastomeric compound.

4. An apparatus as in claim 1 wherein said first end of said first arm is pivotally attached to said channel member, such that said second end of said second arm rotates about said first end of said first arm.

5. An apparatus as in claim 4 wherein said first and second arms rotate between a generally horizontal position and a generally vertical position.

6. An apparatus as in claim 1 wherein said clamp is adjustably attached to said element.

7. Apparatus as in claim 1 wherein said clamp comprises a base attached to said element;

a lever having a first and a second end, said first end being pivotally mounted to said base for rotation between an open and a closed position; and a rod having a first and a second end, said first end being pivotally attached to said lever at a point spaced apart from said first end of said lever and said second end of said rod having a bend formed therein such that when said first end of said lever is rotated to said open position said rod extends outwardly from said apparatus, whereby when said second end of said rod engages an aperture in the watercraft, and said lever is then pivoted toward said closed position, a portion of the watercraft adjacent the aperture engages said guide attaching the watercraft to the apparatus.

8. Apparatus as in claim 7 wherein said clamp further comprises a locking means securing said lever in said closed position.

9. Apparatus as in claim 1 wherein said clamp comprises a base attached to said element;

a plunger mechanism having a cylinder with a bore therethrough being attached to said base, a piston extending through said bore, one end of said piston being attached to a handle for movement of at least a portion of said piston within said bore between an open and a closed position such that in said closed position said piston extends from said cylinder, whereby when said piston engages an aperture in the watercraft, a portion of the watercraft adjacent the aperture engages said guide attaching the watercraft to the apparatus.

10. An apparatus as in claim 1 wherein said guide is adjustably attached to said second end of said second arm.

11. Apparatus for securing a watercraft to a dock, said apparatus comprising:

a beam having means thereon for mounting said beam to a dock, said beam comprising a pair of adjacent, generally parallel legs, each leg having a free end and outwardly facing sides, each said free end having an end section, each said end section being bent towards the other leg;

a channel member slidably carried by said beam for movement there along, said channel member comprising a channel web and a pair of flanges extending outwardly therefrom, said channel member being sized and configured to receive said beam between said flanges such that said end sections of said legs of said beam lie adjacent said channel web of said channel member; and a plate attached to but spaced apart from said channel web such that at least a portion of said end sections lie between said plate and said channel member such that said plate slidably engages said end sections of said legs, whereby said channel member is slidably attached to said beam;

a first arm and a second arm, each having first and second ends, said first end of said first arm being attached to said channel member;

a flexible connector having a first end attached to said second end of said first arm and a second end attached to said first end of said second arm; and an attaching means attached to said second end of said second arm, said attaching means having means thereon for attaching said apparatus to a watercraft.

* * * * *